US005586592A

United States Patent [19]

McGregor

[11] Patent Number: 5,586,592

[45] Date of Patent: Dec. 24, 1996

[54] ROLLING SHUTTER AND SHUTTER DRIVE

[76] Inventor: Thomas McGregor, 1621 S. Ivanhoe St., Anaheim, Calif. 92804

[21] Appl. No.: 428,900

[22] Filed: Apr. 25, 1995

[51] Int. Cl.[6] ..... E06B 9/08

[52] U.S. Cl. ..... 160/133; 160/183; 160/310

[58] Field of Search ..... 160/133, 183, 160/32, 33, 34, 35, 36, 199, 206, 207, 310, 232, 236

[56] References Cited

U.S. PATENT DOCUMENTS

| | | | |
|---|---|---|---|
| 3,173,475 | 3/1965 | Wegner | 160/133 |
| 3,989,084 | 11/1976 | Inamura et al. | 160/133 X |
| 4,294,302 | 10/1981 | Ricke | 160/133 |
| 4,725,000 | 2/1988 | Deziel | 160/133 |
| 4,747,441 | 5/1988 | Apolzer et al. | 160/206 |
| 4,795,206 | 1/1989 | Adams | 160/36 X |
| 5,469,905 | 11/1995 | McKinney et al. | 160/183 X |

*Primary Examiner*—David M. Purol
*Attorney, Agent, or Firm*—Roy A. Ekstrand

[57] ABSTRACT

A rolling shutter includes a plurality of elongated shutter elements each having a plurality of alternate ribs and valleys formed on each side thereof is pivotally coupled by a plurality of link elements interleaved between the shutter elements. The shutter element and link array thus formed includes a repeated subset combination of coupling links and shutter elements which faciltate the pivotal motion of a shutter element pair about a common link to form a reinforcing portion of the shutter element array. A tractor drive mechanism includes a plurality of drive belts having engaging teeth for coupling to the alternate ribs and valleys of the shutter elements to provide positive drive force in either direction. A spring-biased take-up roll is supported in proximity to the tractor drive to receive the portion of the shutter element array withdrawn into the tractor drive.

19 Claims, 6 Drawing Sheets

ROLLING SHUTTER AND SHUTTER DRIVE

FIELD OF THE INVENTION

This invention relates generally to rolling shutter devices and particularly to the shutter element structures and drive apparatus used therewith.

BACKGROUND OF THE INVENTION

One of the more promising home comfort and security enhancements to have been developed in recent years is provided by devices known generally as rolling shutters. Such rolling shutters have provided a convenient mechanism by which a building window or doorway may be conveniently shaded and to some extent secured by closing a movable shutter supported by guide rails on each side of the building window or doorway or other similar opening. While the particular designs and structures of such rolling shutters have been subject to substantial variation in the art, generally all include a plurality of elongated relatively lightweight elements also referred to in the art as "slats" which are usually formed of a lightweight metal or extruded plastic material and which are often filled with a foam material. The plurality of elements are coupled together by hinged couplings to form a multifaceted curtain or blind capable of being rolled upon a supply roller and straightened out to form a relatively planar shutter. A pair of guide rails are secured to each side of the to-be-shuttered window or door opening which receive the end portions of the elements to guide their travel. A rotatable roller often having a drive motor coupled thereto is secured above the guide rails extending across the to-be-shuttered window or doorway. The elements are secured to and rolled upon the roller which is typically covered by a housing cover or the like. One of the most common types of roller drives utilizes a structure known in the art as a "tubular motor" which is generally cylindrical in shape and is readily coupled to an elongated drive axle tube which in essence supports the rolled elements and provides the basic roller structure. In the typical operation of such rolling shutters, the shutter is opened by simply rolling the elements upon the roller and withdrawing the elements from the guide rails exposing the window or door opening. Conversely, closure or shuttering is accomplished by rotating the roller to unroll the elements and allow the elements to be guided downwardly through the guide rails under the influence of gravity until all or part of the window or door opening is covered by the shutter elements.

A frequent variation of such rolling shutters utilizes hinge structures between the elements which in addition to providing a pivoting attachment also provides for some extension of the distance between the shutter elements. In such case, the shutter elements define a plurality of elongated slots or apertures positioned close to the hinge mechanism which are exposed when the hinge mechanism is extended and which are covered when the hinge mechanism is compressed. The provision has become popular among consumers by providing an optional configuration of the shutter in which the shutter is unrolled to less than full closure allowing the gravity effect upon the elements to extend each hinge structure and expose the various elongated apertures thereby providing a small amount of light transmission through the shutter element array or, alternatively, unrolling the shutter to its full downward position to cause the hinge structures to be contracted thereby providing full darkening and closure of the elongated slots.

While the prior art rolling shutters have provided some improvement in securing and shading various homes and commercial facilities, they remain nonetheless subject to substantial problems and limitations. For example, one of the major limitations and problems associated with such rolling shutters is the general weakness of the shutter itself due to the orientation of the elongated relatively lightweight shutter elements when the shutter is closed. Of necessity in fabricating an effective and practical rolling shutter, the shutter elements must be relatively lightweight and therefore fabricated from relative light materials. In addition, the basic design and structure of such rolling shutters orients the shutter elements in their weakest position in terms of resisting external forces such as high winds or the like. Another serious limitation found in prior art rolling shutters is their general dependence upon installation in a vertical orientation. This arises due to the need for gravity forces upon the shutter elements to facilitate the above-described operation. While vertical orientation is encountered in a substantial number of applications such as conventional windows and doors, there remain nonetheless a number of potential installations which cannot be accommodated by conventional rolling shutters. Such potential installations include windows angled significantly from a vertical orientation, skylights or the like, patio cover roofs or the like and sunporch type glass enclosures. In addition to the above limitations, prior art rolling shutters generally require the positioning of the roller above the to-be-shuttered window or doorway. This precludes use of the rolling shutter in a side to side installation or an installation in which the roller is positioned along the bottom edge of the window or doorway.

In view of the foregoing limitations and problems associated with prior art rolling shutters, there arises a need in the art for stronger, more effective gravity independent rolling shutters. There arises a further need in the art for improved rolling shutters which may be readily installed at different angles and orientations and which are better able to resist strong forces such as high winds or the like.

SUMMARY OF THE INVENTION

Accordingly, it is a general object of the present invention to provide an improved rolling shutter. It is a more particular object of the present invention to provide an improved rolling shutter and shutter drive mechanism which cooperate to provide a high strength shutter which may be installed at virtually any orientation or angle of inclination.

In accordance with the present invention, there is provided a rolling shutter covering an area comprising: a shutter element array having a plurality of elongated shutter elements and a plurality of elongated links intercoupling the shutter elements; a take-up roll coupled to the shutter element array for rolling the shutter element array; a shutter drive operatively coupled to the shutter element array for moving the shutter element array to and from the take-up roller; and shutter guide means for guiding the shutter element array into a position overlying the area, the elongated links including at least one set formed of an apex link coupled to a pair of the shutter elements and a pair of angle links coupled to each of the shutter elements in the pair such that the pair of shutter elements form an included angle therebetween less than one hundred eighty degrees when the shutter element array is compressively loaded.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
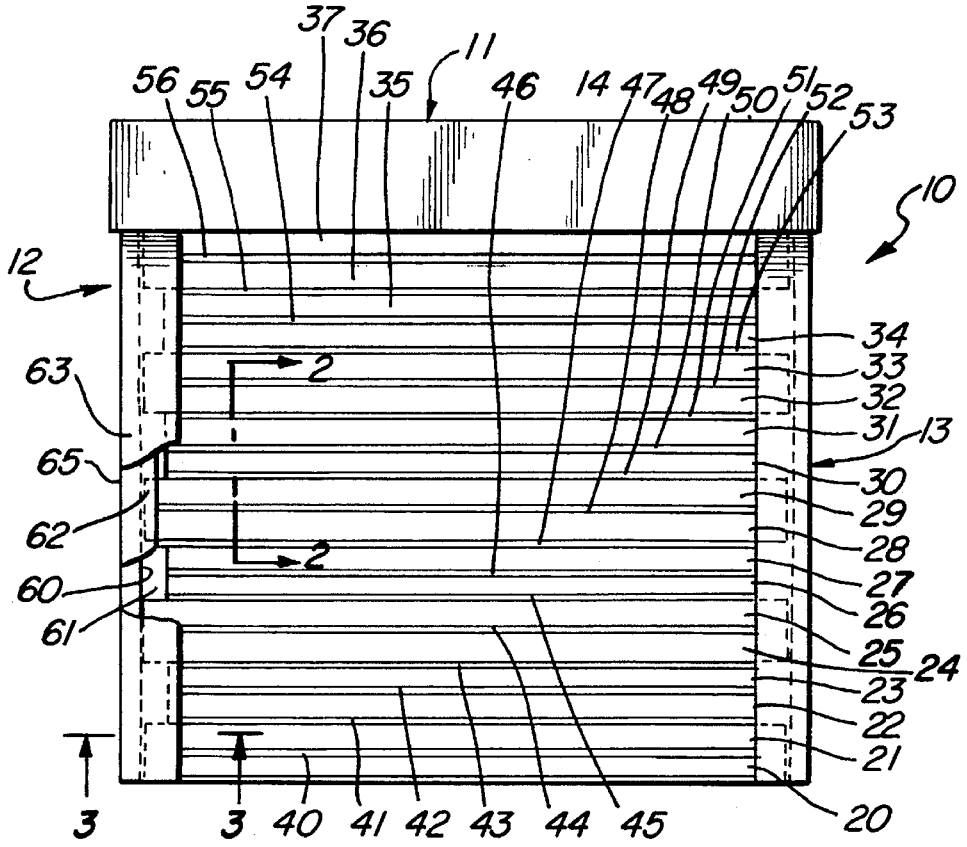
FIG. 1 sets forth a partially sectioned front elevation view of an improved rolling shutter and shutter drive constructed in accordance with the present invention.

FIG. 1 sets forth a front elevation view of a rolling shutter and shutter drive constructed in accordance with the present invention and generally referenced by numeral 10. Rolling shutter 10 is shown in the closed position in which the curtain of horizontally disposed elements is lowered to completely cover the underlying door or window (not shown). It should be noted by way of overview that rolling shutter 10 is in accordance with an important aspect of the present invention capable of closure to either of two configurations both of which are shown in cross-section in FIGS. 2A and 2B. Suffice it to note for purposes of illustration in FIG. 1, however, that rolling shutter 10 has driven the plurality of horizontally disposed elements to the full covering or lowered position. It should also be noted that while the example of FIG. 1 sets forth a vertically oriented rolling shutter installation, the present invention is fully operable in virtually any position as is described below including angled installations, inverted installations as well as side to side installations.

More specifically, rolling shutter 10 includes a roller housing 11 which as is set forth below in greater detail supports a rotatable roll upon which shutter elements are rolled when the shutter is raised together with a novel tractor drive mechanism which provides the powered movement of the shutter elements. A pair of guide rails 12 and 13 having virtually identical mirror image construction are positioned on each side of the to-be-shuttered opening (not shown) and extend downwardly from roller housing 11. A plurality of elongated shutter elements 20 through 37 are serially coupled to a plurality of interconnecting pivotal links 40 through 56 to provide a somewhat flexible curtain-like array of elements 20 through 37. The detail structure of shutter elements 20 through 37 as well as the interconnecting links used therewith is set forth below in FIGS. 2A and 2B in greater detail. However, suffice it to note here that each element is pivotally joined to the next successive element in the element array by an elongated connecting link. In further accordance with an important aspect of the present invention set forth below in FIGS. 2A and 2B in greater detail, elements 20 through 37 are provided in either of two lengths to facilitate the configuration of rolling shutter 10 in the triangular reinforcing configuration shown in FIG. 2B. Thus, in the example of FIG. 1, shutter elements 20 and 21 exhibit the longer length and are interconnected by a link 40. In contrast, shutter elements 22 and 23 exhibit the shorter length and are interconnected by a link 42. Correspondingly, elements 24 and 25 are longer and connected by a link 44 while elements 26 and 27 are shorter and are connected by a link 46 and so on in an arrangement in which alternate pairs of elements are of different length. It will be apparent to those skilled in the art from the examples and descriptions which follow, however, that the invention is not limited to an alternate pair arrangement of long and short shutter elements but rather is merely shown for purposes of illustration. For example, a substantially greater number of longer elements may be utilized in place of the long element pairs without departing from the spirit and scope of the present invention.

Figure 3A:
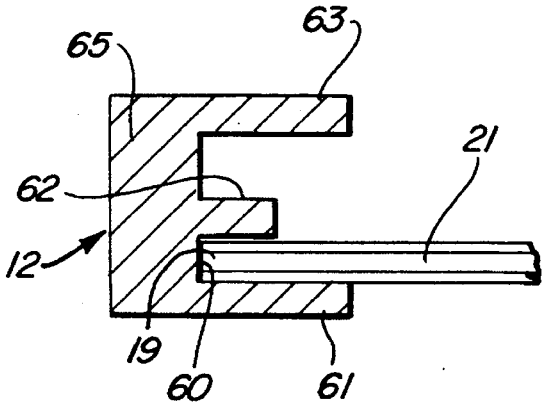
FIGS. 3A and 3B set forth section views of the present invention improved rolling shutter and shutter drive taken along section lines 3—3 in FIG. 1 showing the present invention shutter in the extended and contracted positions respectively.
Figure 3B:
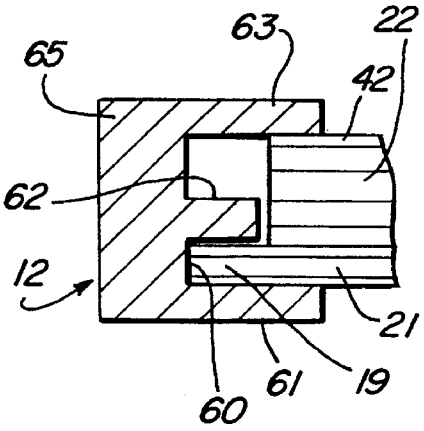
Figure 2A:
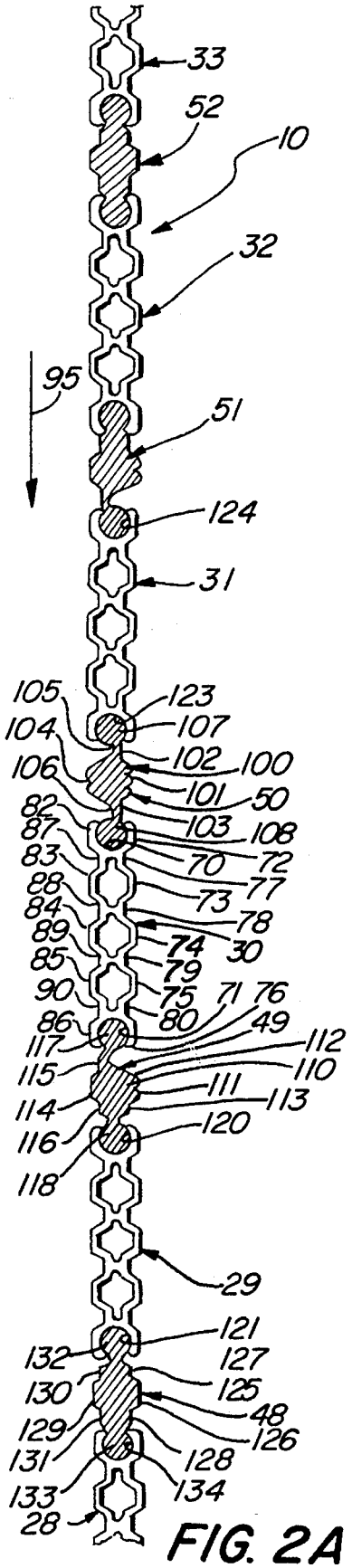
FIGS. 2A and 2B set forth partial section views of the present invention improved rolling shutter and shutter drive taken along section lines 2—2 in FIG. 1 showing the rolling shutter element configuration in the extended and contracted positions respectively.
Figure 2B:
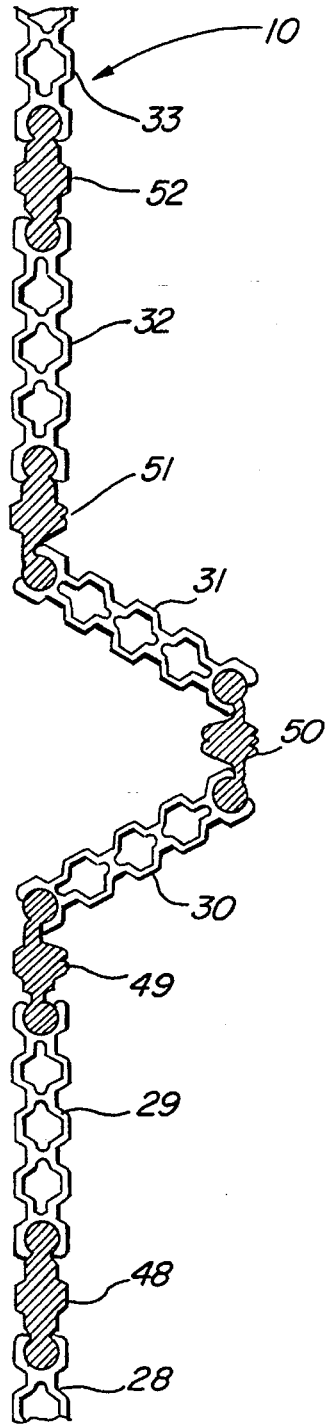

In further accordance with the present invention and the capability of the present invention rolling shutter to be configured in a triangular reinforcing configuration shown in FIG. 2B, guide rails 12 and 13 are configured as shown in greater detail in FIGS. 3A and 3B to receive and support the combination of longer and shorter shutter elements. Accordingly, it should be noted that guide rail 12 for example includes a generally planar outer plate 63 supported by a guide rail body 65 which further supports an intermediate plate 62 and an inner plate 61. The latter forms the inner most plate of guide rail 12 and is typically secured to the underlying surface such as a building sidewall or roof or the like. Intermediate plate 62 is shorter in length than either outer plate 63 or inner plate 61 to facilitate the angular pivoting of the shorter element pairs such as elements 31 and 30 shown in FIG. 2B. Concurrently, the channel formed between intermediate plate 62 and inner plate 61 (channel 60 shown in FIG. 3A) receives the end portions of the longer shutter elements such as elements 20 and 21, 24 and 25, 28 and 29 and so on.

In operation, rolling shutter 10 is raised in the manner described below by activating the tractor drive supported within roller housing 11 to draw the curtain of shutter elements and interconnecting links upwardly into roller housing 11 and roll the pivotally connected shutter elements upon a take-up roller also supported within roller housing 11. This process is carried forward until the desired number of shutter elements remain lowered to cover a portion of the door or window opening or, alternatively, until the entire element array has been drawn into roller housing 11 and is rolled upon the take-up roller therein. During this raising of the rolling shutter, the array of elements and links are guided within guide rails 12 and 13 primarily by the extension of the longer shutter elements into the channels formed therein.

The rolling shutter may be closed by reversing the take-up action and engaging the shutter drive mechanism within housing 11 in the opposite direction driving the shutter array outwardly from roller housing 11 to provide partial or complete closure of the underlying building opening such as a door, window, skylight, patio cover or other to-be-shuttered surface. In further accordance with the present invention once the bottommost element, in this case element 20, has reached the lowest travel point of the rolling shutter, the user may cease operation of the shutter drive mechanism leaving the rolling shutter in the generally flat or planar configuration shown in FIG. 1. Alternatively, however, and in accordance with an important aspect of the present invention, the user may elect to further drive the shutter element array outwardly from roller housing 11 causing the shutter element array to assume the strengthened triangular configuration shown in FIG. 2B. With temporary reference to FIGS. 2A and 2B, it should be understood that FIG. 2A sets forth a section view along section lines 2—2 in FIG. 1 in which the rolling shutter is simply extended to its covering configuration as shown in FIG. 1. In contrast, FIG. 2B sets forth the section view along section lines 2—2 in FIG. 1 in which the present invention shutter has been further driven to assume the strengthened configuration in which pairs of elements such as elements 30 and 31 are pivoted outwardly about an apex link 50 to assume a triangular reinforcing configuration. This triangular reinforcing configuration is formed by each of the pairs of shorter shutter elements to provide a plurality of transversely extending high strength triangular reinforcement for the present invention shutter. Continuing with temporary reference to FIG. 2B, it should be noted that link 50 referred to herein as an apex-type link due to its ability to form the apex of the triangular reinforcing elements, permits substantial angular pivoting of each adjacent shutter element (in this example elements 30 and 31). To further accommodate the angular pivoting of the triangular reinforcing configuration, elements 30 and 31 are pivotable about their connecting ends to links 49 and 51 respectively on each side of apex link 50. As a result, links such as 49 and 51 are herein referred to angle links for reference purposes in view of their capability to provide angular pivoting of the shutter elements coupled to an apex link. The third type of link used herein is referred to herein as a planar link due to its characteristic of substantially limiting the pivoting capability of the shutter elements secured thereto. Examples of such planar links are shown in FIG. 2B as links 48 and 52.

Returning to FIG. 1 and the example of the present invention rolling shutter set forth therein, it should be noted that links 40, 46, 50 and 54 are apex links while links 41, 43, 45, 47, 49, 51, 53 and 55 are angle links. The remaining links within the rolling shutter, that is links 40, 44, 48, 52 and 56 are planar links. Further examination of FIG. 1 in view of FIGS. 2A and 2B shows that the basic combination of a pair of shorter length shutter elements commonly coupled by an apex link and having angle links on each opposite side thereof is repeated throughout the shutter element array. This basic combination of an apex link, two shorter length shutter elements and oppositely oriented angle links forms the basic triangular configuration unit of the present invention shutter. It will be equally apparent to those skilled in the art that the number of greater length shutter elements and interconnecting planar links in the element array of the present invention rolling shutter may be varied substantially to meet different operating environments and installations. For example, FIG. 1 shows a shutter element array in which pairs of greater length shutter elements and a single interconnecting planar link are utilized between each triangular element combination. However, different pluralities may be used such as three greater length elements coupled by an interposed pair of planar links or four greater length elements commonly coupled by three interposed planar links and so on. Also, it will be apparent that the pair of greater length shutter elements shown in FIG. 1 may be replaced by a single greater length shutter element having angle links on each side thereof and eliminating the planar link. The effect of varying the number of greater length shutter elements and planar links simply changes the ratio of planar shutter elements to triangular reinforcing elements in the final shutter array.

FIG. 2A sets forth a section view of the present invention rolling shutter taken along section lines 2—2 in FIG. 1. More specifically, FIG. 2A sets forth a section view of the present invention shutter configured in its planar configuration. In contrast, FIG. 2B sets forth a section view taken along section lines 2—2 in FIG. 1 showing the present invention rolling shutter configured in its reinforced or strengthened array characterized by a plurality of triangular configurations between shutter element pairs. Thus, with simultaneous reference to FIGS. 2A and 2B, the portion of rolling shutter 10 shown includes a plurality of shutter elements 28 through 33 interconnected by a plurality of pivotal coupling links 48 through 52. Element 30 is typical of the present invention shutter element and includes a socket end 70 along one edge and a socket end 71 along the opposite edge each defining elongated cylindrical socket recesses. Element 30 further defines a plurality of raised rib portions 72 through 76 evenly spaced along one side thereof and defining interleaved valley portions 77 through 80. Element 30 defines a mirror image plurality of ribs 82 through 86 and interleaved valley portions 87 through 90 on the opposite side thereof. Thus, element 30 is shown to have a cylindrical socket portion on each end and an outer configuration which defines evenly spaced ribs separated by valley portions. As is described below in greater detail, the importance of the cross-sectional shape of element 30 is its correspondence with the shape and spacing of the plurality of belt teeth used in the tractor drive mechanism shown in detail in FIGS. 9 through 11 below. Suffice it to note here, however, that the outer shape of element 30 facilitates the direct engagement thereof with a conventional tractor drive belt on either side. In the example of FIGS. 1 and 2, each shutter element is identical to element 30 and thus element 31 defines a corresponding plurality of ribs and valleys therebetween identical to element 30. Element 31 also defines cylindrical socket recesses 124 and 123 along each edge thereof.

Apex link 50 defines a center body 100 having a rib 101 extending in one direction and a corresponding rib 104 extending in the opposite direction. Link 50 further includes a pair of cylindrical coupling elements 107 and 108 on each side of body 100 and joined thereto. Cylindrical elements 107 and 108 are spaced from ribs 101 and 104 to provide valleys 102 and 103 as well as valleys 105 and 106 therebetween. As a result, when apex link 50 is assembled to elements 30 and 31 by sliding cylindrical portions 108 and 107 into sockets 70 and 123 respectively, the spacing of outwardly extending ribs defined by elements 30 and 31. is maintained and thus the combination of shutter elements 30 and 31 as well as link 50 may be continuously engaged on each side by the above-mentioned tractor drive belt. Rolling shutter 10 further includes an angle link 49 having a center body 110 defining a pair of oppositely extending ribs 111 and 114. Link 49 further includes an elongated cylindrical member 117 on one side and an elongated cylindrical member 118 on the remaining side of center body 110. Cylindrical member 117 is received within socket end 71 of element 30 while cylindrical member 118 is received within socket end 120 of shutter element 29. In similarity to link 50, link 49 utilizes ribs 111 and 114 to maintain the rib spacing established by the shutter elements of rolling shutter 10. Thus, the combination of shutter elements 29 and 30 and link 49 may be directly engaged by the traction drive belt of the shutter drive system on both sides. Shutter 10 further includes an angle link 51 coupled between elements 31 and 32 in the same fashion described for link 49 between elements 29 and 30. In contrast, however, it should be noted that while link 51 is identical in structure to link 49, its position is reversed from that shown for link 49. Thus, link 51 is coupled between elements 31 and 32 such that element 31 may be pivoted through a substantial angle as shown in FIG. 2B with respect to link 51 and element 32. In a similar fashion, link 49 is oriented such that element 30 may be pivoted through a substantial angle with respect to link 49 and element 29 as shown in FIG. 2B. Apex link 50 is configured to facilitate the pivoting of elements 30 and 31 through substantial angles with respect to link 50 as shown in FIG. 2B. The remaining segment of shutter 10 shown in FIGS. 2A and 2B is formed of planar links 48 and 52 coupling elements 29 and 32 respectively to elements 28 and 33. Links 48 and 52 are substantially identical in construction and are referred to as planar links. For example, link 48 includes a center body 125 having oppositely extending rib portions 126 and 129 on each side and cylindrical members 132 and 133 on each end. Correspondingly, elements 28 and 29 define sockets 134 and 121 respectively which receive cylindrical portions 133 and 132 to provide pivotal coupling between elements 28 and 29. Link 52 similarly couples links 32 and 33. It should be noted that links such as links 48 and 52 referred to herein as planar links nonetheless facilitate a small angle pivotal motion in their coupling to shutter elements which is important to the operation of the tractor drive mechanism described below. However, substantially, links such as 48 and 52 are intended to generally maintain a substantially straight line orientation between the shutter elements which they couple.

In accordance with an important aspect of the present invention, the imposition of a compressive force upon the combined elements and links of the present invention rolling shutter causes the present invention shutter to be configured from the straight line or planar position shown in FIG. 2A to the triangularly reinforced configuration shown in FIG. 2B. For example, a force in the direction indicated by arrow 95 which is resisted either by the end of travel by the shutter element array or using a friction producing edge element such as those shown in FIGS. 7A and 7B produces a compressive force between the shutter elements and interconnecting links. In accordance with an important aspect of the present invention, this compressive force results in substantial angular pivotal motion of shutter elements 30 and 31 about links 49 and 51 as well as apex link 50. The compressive force is continued as apex link 50 is forced outwardly toward the configuration shown in FIG. 2B until the pivotal angular movement of elements 30 and 31 with respect to links 49 and 51 is reached and the triangular configuration shown in FIG. 2B is assumed. It should be noted by examination of FIG. 2B in greater detail that the edge portions of elements 30 and 31 are brought into contact with the valley portions of their coupling links to provide a strong force resisting coupling which precludes further pivotal motion of elements 30 and 31 and which thereby stabilizes the triangular combination of apex link 50, shutter elements 30 and 31, and angle links 49 and 50.

As described above, the present invention rolling shutter utilizes repeated shutter and link combinations corresponding to apex link 50, shutter elements 30 and 31 and angle links 49 and 51 as a basic strengthening element of the present invention rolling shutter. Thus, the present invention rolling shutter may be described as a plurality of these triangular reinforcing element and link sets which are repeated throughout the shutter array and which are interspaced with combinations of planar links such as links 48 and 52 and additional shutter elements. As is also mentioned above, the number of triangular reinforcing elements and links utilized is selected in accordance with the particular application encountered. It will be readily understood by those skilled in the art the substantial increase in strength provided by the present invention shutters having assumed the triangular reinforcing configuration shown in FIG. 2B. In essence, the angled orientation and triangular shape of the elements in the configuration of FIG. 2B resists substantially greater wind loads and other forces without increasing the material strength or thickness of the shutter elements. It should be further understood that the present invention rolling shutter is capable of configuration in its reinforced position regardless of orientation with respect to gravity. All that is required within the shutter array is the ability of the drive system to produce a compressive force to provide the triangularized array. Thus, the present invention system is operable in side to side, angled, and inverted positions with equal effectiveness.

FIGS. 3A and 3B set forth partial section views of the present invention rolling shutter taken along section lines 3—3 in FIG. 1. FIG. 3A sets forth the present invention rolling shutter in the straight line or planar configuration of FIG. 2A while FIG. 3B sets forth the present invention shutter in the triangularized or reinforced configuration shown in FIG. 2B. Thus, with simultaneous reference to FIGS. 3A and 3B, shutter 10 includes a guide rail 12 having a guide rail body 65 supporting a generally planar outer plate 63 and a generally planar inner plate 61. Guide rail 12 further includes an intermediate plate 62 extending from body 65 and positioned between plates 61 and 63. A channel 60 is formed between intermediate plate 62 and inner plate 61 which receives the end portions of the greater length shutter elements such as shutter element 21. Thus shutter element 21 defines an end portion 19 received within channel 60 to provide sliding engagement of shutter element 21 within guide rail 12. It should be noted that intermediate plate 62 is substantially shorter than plates 61 or 63.

Thus, with the present invention rolling shutter configured in a planar or straight line arrangement such as that shown in FIG. 1, shutter elements 20 through 37 define a generally planar array and are supported within guide rail 12 in a substantially planar arrangement. In contrast and with reference to FIG. 3B when the present invention rolling shutter is driven into its triangularized or strengthened configuration corresponding to that shown in FIG. 2B, the shorter shutter elements are forced to their triangularized positions. By way of example, FIG. 3B shows shutter element 21 having end 19 received within channel 60 while shorter length shutter element 22 is forced upwardly moving link 42 against outer plate 63 in the above-described triangularized strengthening configuration. It should be noted the shorter length of intermediate plate 62 is sufficient to captivate end 19 of shutter element 21 but provides ample clearance for the pivotal movement of shorter shutter elements such as element 22. Thus, in either configuration, the array of shutter elements is slidably supported within guide rail 12. It will be understood by those skilled in the art that guide rail 13 positioned on the opposite side of the rolling shutter as shown in FIG. 1 is identical to guide rail 12 and is oppositely oriented during assembly to provide a corresponding sliding engagement for the opposite side of the rolling shutter.

Figure 4A:
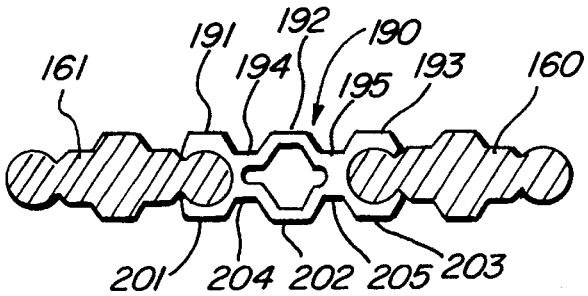
FIG. 4A sets forth a section view of a typical element and link combination of the present invention.
Figure 4B:
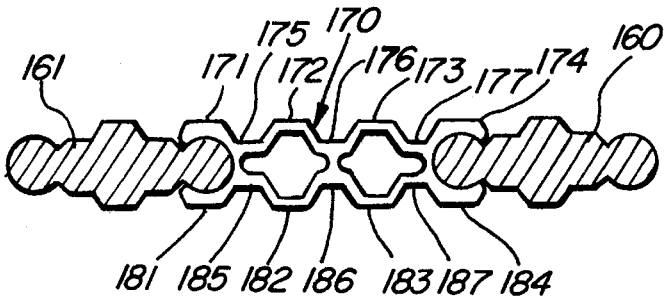
FIG. 4B sets forth a section view of an alternate element and link combination.
Figure 4C:
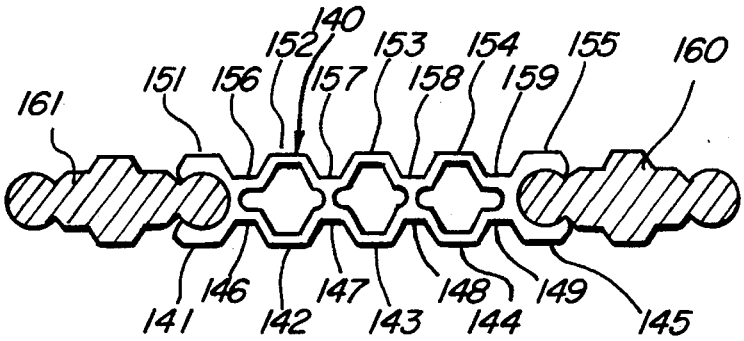
FIG. 4C sets forth a section view of a still further alternate element and link combination.

FIGS. 4A, 4B, 4C and 4D set forth alternate shutter element sizes for use in the present invention rolling shutter. FIGS. 4A, 4B and 4C set forth examples of shutter elements having different widths and different numbers of extending rib portions. Each of the shutter elements shown in FIGS. 4A, 4B and 4C are shown commonly coupled to planar links 160 and 161 on each side thereof. Thus, FIG. 4A shows a relatively narrow shutter element 190 having a plurality of extending rib portions 191, 192 and 193 and interleaved valley portions 194 and 195 formed on one side and a corresponding plurality of rib portions 201, 202 and 203 together with interleaved valley portions 204 and 205 on the remaining side. Also shown in FIG. 4A is the pivotal coupling between links 160 and 161 to each edge of shutter element 190 in the manner described above.

FIG. 4B sets forth a slightly wider shutter element 170 coupled to planar links 160 and 161. Shutter element 170 defines a plurality of raised ribs 171, 172, 173 and 174 having interleaved valley portions 175, 176 and 177 on one side and a corresponding plurality of oppositely facing rib portions 181, 182, 183 and 184 and interleaved valley portions 185, 186 and 187 on the opposite side. Once again, shutter element 170 is coupled to planar elements 160 and 161 in the manner described above.

FIG. 4C sets forth a larger shutter element 140 defining a plurality of raised ribs 151, 152, 153 and 154 and 155 together with interleaved valley portions 156, 157, 158 and 159 formed on one side thereof. Shutter element 140 defines an oppositely facing plurality of ribs 141, 142, 143, 144 and 145 together with interleaved valley portions 146, 147, 148 and 149 on the remaining side. Shutter element 140 is coupled to planar links 160 and 161.

Figure 4D:
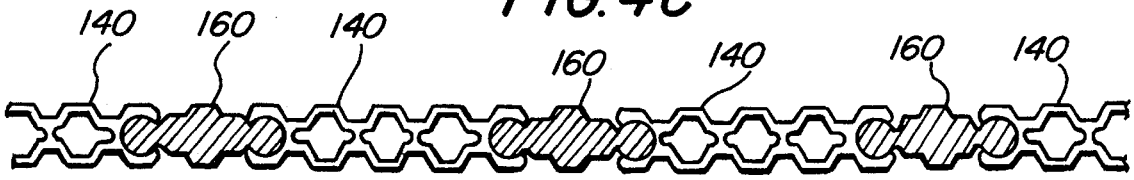
FIG. 4D sets forth a section view of a still further alternate combination of elements and links.

FIG. 4D sets forth the combination of a plurality of planar links such as link 160 coupled to a plurality of shutter elements such as shutter element 140 to form a substantially greater span of planar elements rather than the limited pair of planar elements set forth above in FIGS. 1 and 2. Thus, it should be understood by those skilled in the art that the present invention rolling shutter may be fabricated using a substantial number of planar links such as link 160 between elements where a smaller number of triangularized reinforcing combinations will suffice. It should also be noted that the tractor drive apparatus set forth below in greater detail in FIGS. 9 through 11 may be utilized in combination with a plurality of shutter elements and coupling links which is formed entirely of shutter elements such as element 140 and planar links such as link 160 to nonetheless realize the benefits of the tractor drive system without the triangularized reinforcing capability. It should also be noted that the present invention is not limited to shutter arrays in which each shutter element is the same width. For example, a plurality of shutter elements such as shutter elements 140, 170 and 190 may readily be utilized with coupling links such as those described herein without departing from the spirit and scope of the present invention.

Figure 5:
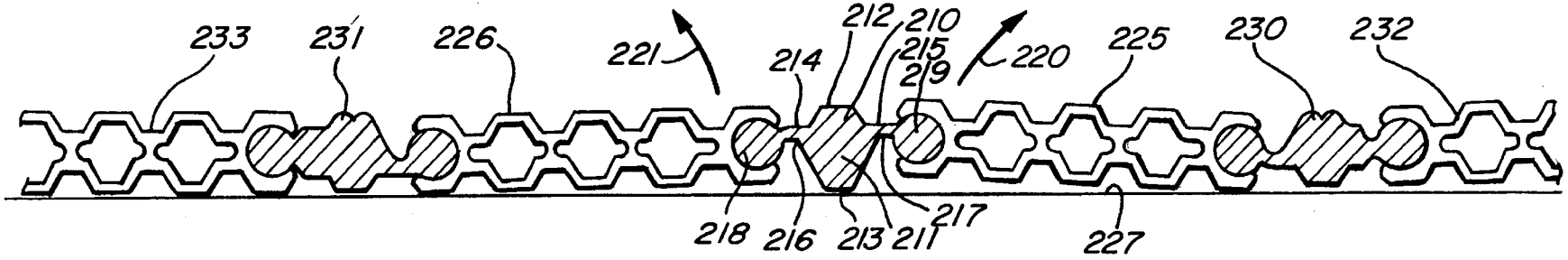
FIG. 5 sets forth a partial section view of an alternate embodiment of the present invention rolling shutter.

FIG. 5 sets forth a section view of an alternate embodiment of the present invention operation in a generally horizontal orientation. Accordingly, a horizontally disposed guide rail surface 227 supports a plurality of shutter elements 225, 226, 232 and 233 together with an apex link 210 and a pair of angle links 230 and 231 providing interconnections. It will be understood that FIG. 5 omits the details of the guide rail supporting the rolling shutter of FIG. 5. However, it will be equally well understood that the guide rail structures used may, for example, correspond to guide rails 12 and 13 (seen in FIG. 1). The embodiment of the present invention shown in FIG. 5 is, of course, a partial segment of the shutter element and link array which may extend in each direction for any desired length. It will be equally apparent to those skilled in the art that the segment of the embodiment shown in FIG. 5 corresponds to the triangularized reinforcing segment such as that shown in FIG. 2B. Accordingly, an apex link 210 includes a body 211 having oppositely facing ribs 212 and 213. Link 210 further includes cylindrical portions 218 and 219 and interleaving valley portions 214 and 215 on one side and 216 and 217 on the opposite side. Of importance to note in the structure of apex link 210 is the extended length of rib 213 which spaces cylindrical portions 218 and 219 away from guide rail surface 227 by predetermined distance. As a result, elements 225 and 226 pivotally coupled to cylindrical portions 218 and 219 respectively are angled with respect to guide rail surface 227. The remainder of the shutter segment shown in FIG. 5 is substantially in accordance with the above-described embodiments in that elements 225 and 226 are coupled to adjacent elements 232 and 233 respectively by angle links 230 and 231.

The object of the embodiment of FIG. 5 in providing an extended rib 213 on apex link 210 is to predispose the combination of link 210 and elements 225 and 226 on each side thereof toward pivotal movement in the direction indicated by arrows 222 and 221. This predisposition assures that under compressive forces as described above in configuring the present invention rolling shutter to the reinforced configuration of FIG. 2B, the pivotal movement of elements 225 and 226 in the direction of arrows 220 and 221 is rendered easier and more reliable. This predisposition of elements 225 and 226 is beneficial in a vertical orientation. However, it is particularly beneficial in angled or horizontal orientation of the present invention rolling shutters.

Figure 6A:
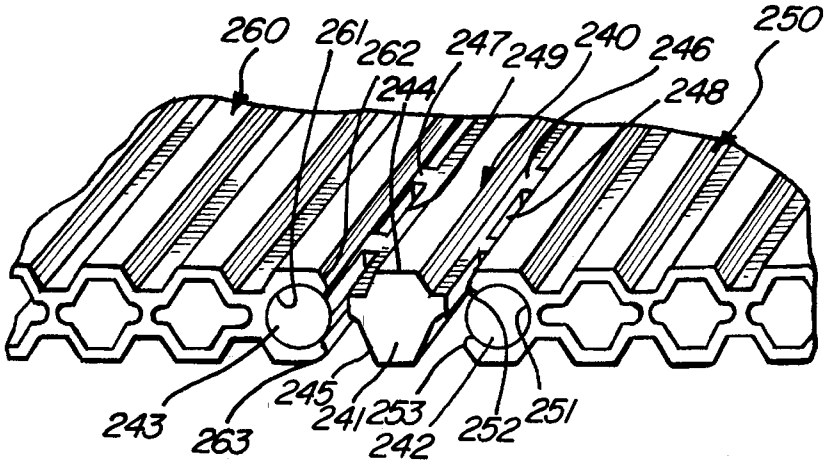
FIGS. 6A and 6B set forth section views of a still further alternate embodiment of the present invention having partial illumination apertures which are shown in the open configuration in FIG. 6A and the closed configuration in FIG. 6B.
Figure 6B:
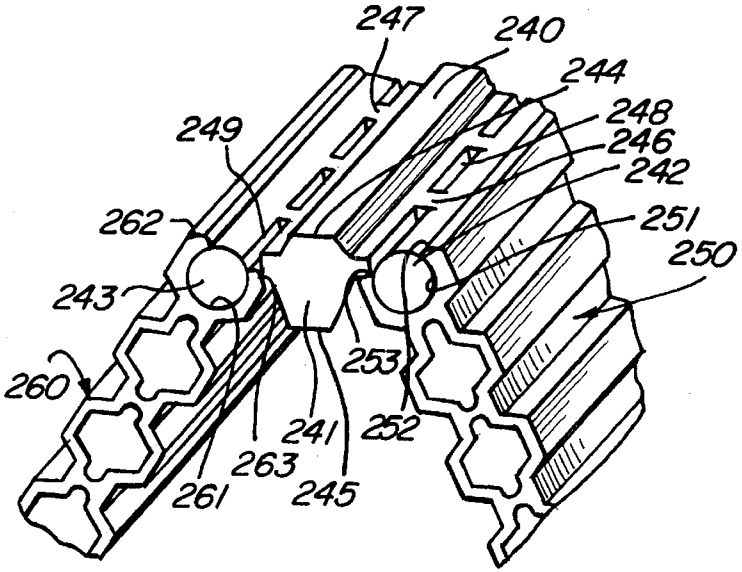

FIGS. 6A and 6B set forth section views of a still further alternate embodiment of the present invention rolling shutters. FIG. 6A sets forth the planar or straight line configuration of the present invention rolling shutter while FIG. 6B sets forth the triangularized configuration of the present invention rolling shutter. Of importance in the embodiment of FIGS. 6A and 6B is the provision of an apex link which defines a plurality of elongated light emitting slots therein which allows the consumer to select the light transmissive qualities of the present invention rolling shutter between subdued light transmission and complete darkening thereby providing the benefits of the prior art rolling shutters described above together with the substantial benefits of the present invention triangularized reinforcing structure.

With simultaneous reference to FIGS. 6A and 6B, an apex link 240 defines a center body 241 having oppositely directed extending ribs 244 and 245 together with a pair of cylindrical members 242 and 243. Cylindrical members 242 and 243 are supported by a pair of webs 246 and 247 respectively which extend outwardly from center body 241. Webs 246 and 247 define a plurality of elongated slots 248 and 249 respectively which extend substantially the entire lengths of webs 246 and 247. Slots 248 and 249 extend entirely through webs 246 and 247 respectively and thus provide light transmissive slots. Apex link 240 is coupled to a pair of shutter elements 250 and 260 on either side thereof. Shutter element 250 defines a cylindrical socket 251 having a pair of end portions 252 and 253 formed along the edge of element 250. Correspondingly, element 260 defines a cylindrical socket 261 receiving cylindrical member 243 and defining end portions 262 and 263.

In the straight line or planar configuration of FIG. 6A, shutter elements 250 and 260 are generally coplanar and configured in a generally straight line relationship with apex link 240. Accordingly, end portions 252 and 253 of shutter element 250 are pivoted away from slots 248 in web 246. Similarly, end portions 262 and 263 of shutter element 260 are pivoted away from slots 249 in web 247. Thus, in the configuration of FIG. 6A, a small amount of light is able to pass through slots 248 and 249 of apex link 240 rendering the straight line or planar configuration of the present invention shutter slightly light transmissive to allow a subdue light to pass through the rolling shutter. It will be appreciated that the number of apex links structured in accordance with apex link 240 within the shutter element array of the rolling shutter determines the degree of light transmissive character exhibited by the shutter in the planar or straight line configuration.

FIG. 6B sets forth elements 250 and 260 and apex link 240 configured as described above when the present invention shutter assumes the triangularized or strengthened configuration as set forth in FIG. 2B. Of importance to note is the angular positions of elements 250 and 260 with respect to apex link 240 causes end 253 of element 250 to block light transmission through slots 248 while end 263 of element 260 is similarly positioned to block light transmission through slots 249. As a result, the light transmission exhibited by the embodiment of FIGS. 6A and 6B in the straight line configuration shown in FIG. 6A is prevented in the triangularized configuration shown in FIG. 6B.

Thus, in the embodiment shown in FIGS. 6A and 6B, one or more of apex links is utilized in the embodiment shown as apex link 240 to provide selective light transmission for the present invention rolling shutter while maintaining the complete light obscurity in the triangularized or fully compacted position.

Figure 7A:
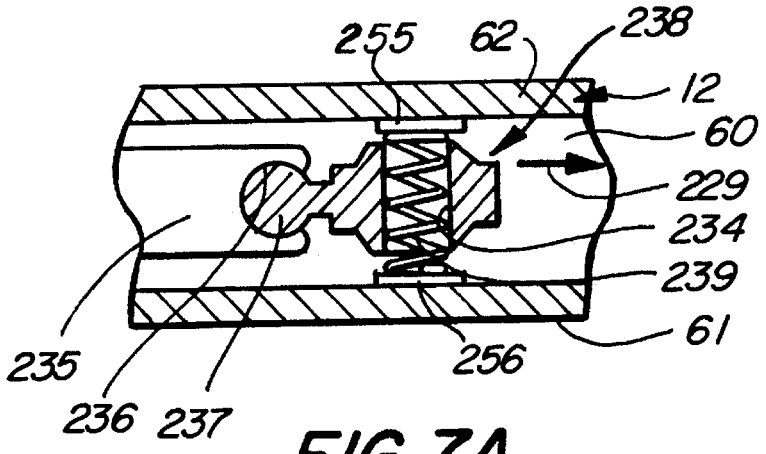
FIG. 7A sets forth a section view of a friction producing bottom element of the present invention rolling shutter.

FIG. 7A sets forth a partial section view of a still further alternate embodiment of the present invention rolling shutter. As described above, the present invention rolling shutter includes a guide rail 12 having an intermediate plate 62 and an inner plate 61 separated to form a channel 60 (better seen in FIG. 3A). Within channel 60 a plurality of shutter elements including a bottom shutter element 235 are movable. In accordance with the embodiment of FIG. 7A, an edge element 238 is coupled to the bottommost element 235 in the above-described shutter array. Element 235 is constructed substantially in accordance with the above-described element structures such as element 140 seen in FIG. 4C and thus defines an elongated cylindrical socket 236 along one edge thereof. Accordingly, edge element 238 includes a cylindrical member 237 received within socket 236. Edge element 238 further defines a transversely extending bore 234 within which a coil spring 239 is captivated. A pair of movable plates 255 and 256 are coupled to spring 239 using conventional fabrication techniques (not shown). Spring 239 produces a compressive force directed outwardly against plates 255 and 256 forcing the plates against the interior surface of intermediate plate 62 and inner plate 61 respectively. As a result, a frictional force is established between edge element 238 and guide rail 12 which resists movement of edge element 238 within channel 60. Of particular interest to the present invention is the effect provided by edge element 238 when the above-described drive operation is carried forward on the shutter array forcing the shutter elements in the direction indicated by arrow 229. The frictional force provided by edge element 238 resists the driving force of the shutter element array produced by the above-mentioned tractor drive apparatus thereby subjecting shutter elements and links of the rolling shutter to a compressive force which facilitates the above-described configuring of the shutter array into its triangularized or reinforced configuration as illustrated in FIG. 2B.

Figure 7B:
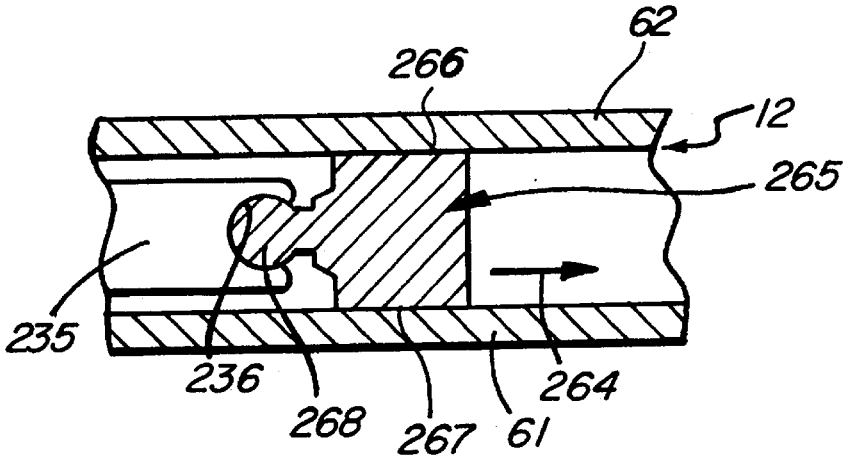
FIG. 7B sets forth a section view of an alternate friction producing bottom element of the present invention rolling shutter.

FIG. 7B sets forth an alternate embodiment of the present invention utilizing a different edge element 265 movable within channel 60 of guide rail 12 in a similar fashion to that described above for edge element 238. Edge element 265 is similarly coupled to element 235 via a cylindrical member 268 received within socket 236. Edge element 265 defines side surfaces 266 and 267 which are fitted against the interior surfaces of intermediate plate 62 and inner plate 61 to provide a frictional force which resists motion of the edge element. In further similarity to the embodiment shown in FIG. 7A, the frictional resistance provided by edge element 265 is operative when the shutter array is driven in the direction of arrow 264 to provide a compressive force upon the array and configure the rolling shutter in the triangularized configuration shown in FIG. 2B. It will be apparent to those skilled in the art that other edge elements may be utilized without departing from the spirit and scope of the present invention. It will be further apparent to those skilled in the art that the use of friction producing edge elements is not necessary in all embodiments practicing the present invention since the array is easily placed in compressive load to provide triangularized configuration by simply driving the end element such as element 235 against a stop surface at the extreme of the shutter travel.

Figure 8:
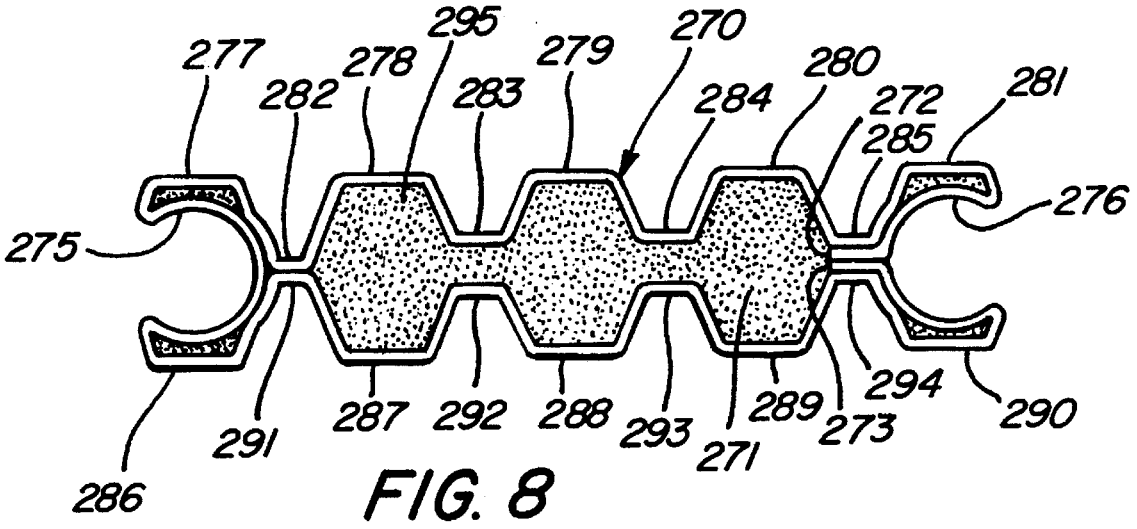
FIG. 8 sets forth a section view of an alternate embodiment of the shutter element of the present invention rolling shutter.

FIG. 8 sets forth a section view of an alternate embodiment of the present invention utilizing a shutter element fabricated of a sheet formed process. For all practical purposes, shutter element 270 is substantially the same as the above described shutter elements which are preferably formed using an extruding process forming lightweight metal or plastic into the above-illustrated shape. Thus, accordingly, shutter element 270 is fabricated of a single sheet 271 of thin formable material such as aluminum or the like to define a pair of cylindrical sockets 275 and 276 at each end and to captivate edge portions 272 and 273 of sheet 271 in proximity to socket 276. Thus, shutter element 270 defines a plurality of ribs 277, 278, 279 and 280 and 281 as well as interleaved valleys 282, 283, 284 and 285 on one side of the shutter element. Shutter element 270 further defines a corresponding plurality of ribs 286, 287, 288, 289 and 290 as well as interleaved valleys 291, 292, 293 and 294 on the remaining side. Edge portions 272 and 273 are fitted between valley portions 285 and 294 and secured therebetween to complete the structure. It may be desirable although not always necessary to provide a conventional attachment between valley portions 285 and 294 and edge portions 272 and 273 using conventional adhesive or welding techniques or their equivalent. To further enhance the structural integrity of shutter element 270, the interior cavity 295 formed therein may be filled with a foam material such as a foamed polyurethane or the like.

Figure 9:
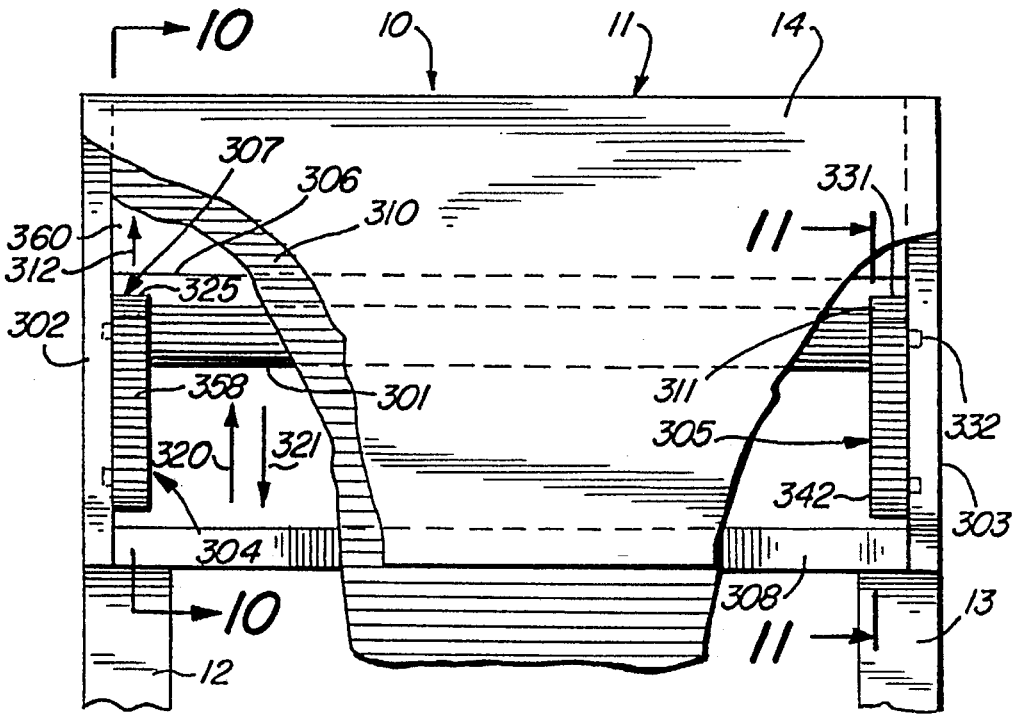
FIG. 9 sets forth a partially sectioned view of the roller and shutter drive of the present invention.
Figure 10:
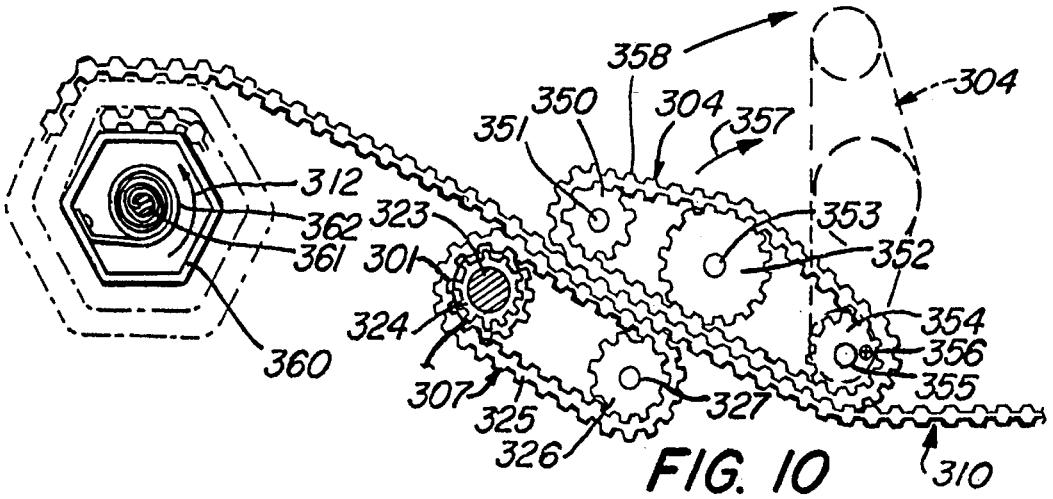
FIG. 10 sets forth a partial section view of the roller and drive of the present invention taken along section lines 10—10.

FIG. 9 sets forth a partial section view of the tractor drive mechanism of the present invention rolling shutter and shutter drive. As described above, rolling shutter 10 includes a roller housing 11 coupled to guide rails 12 and 13 and including a housing cover 14. Housing cover 14 is shown in broken section to expose the interior of roller housing 11. Roller housing 11 includes a pair of end plates 302 and 303 together with a pair of cross supports 306 and 308. The combination of cross supports 306 and 308 together with end plate 302 forms a self-supporting frame which in accordance with conventional fabrication techniques fully supports the operational tractor drive mechanism of the present invention independent of housing cover 14. Thus, in the preferred fabrication of the present invention, housing cover 14 is simply a protective covering and is not required for the integral strength of roller housing 11. This greatly simplifies the installation and maintenance of the present invention improved rolling shutter and shutter drive. A take-up roll 360 is rotatably supported between end plates 302 and 303 using conventional fabrication techniques including a support shaft 361 and torsional spring 362 (both seen in FIG. 10). Take-up roll 360 receives shutter element array 310 and rolls the shutter element array upon the take-up roll as the tractor drive mechanism described below draws the shutter element array into roller housing 11. Thus, as is set forth below in greater detail, it will be understood that take-up roll 360 is urged in the rotational direction indicated by arrow 312 by torsional spring 362 (seen in FIG. 10). A drive tractor 307, the structure of which is set forth below in FIG. 10, is supported within roller housing 11 by conventional fabrication techniques (not shown) and includes a tubular motor 323 (seen in FIG. 10) coupled to a drive axle tube 301. Drive axle tube 301 extends transversely across roller housing 11 and is coupled to a drive tractor 311, the structure of which is set forth below in FIG. 11. Roller housing 11 further supports an idler tractor 304 above drive tractor 307 and a similar idler tractor 305 above drive tractor 311. In accordance with the present invention, drive tractor 307 includes a double-sided toothed belt 325 which as is set forth below engages drive axle tube 301. Similarly, idler tractor 304 includes a double tooth belt 358 while drive tractor 311 includes a double tooth belt 331 and idler tractor 305 includes a double toothed belt 342. The operation of drive tractors 307 and 311 as well as idler tractors 304 and 305 are set forth below in greater detail. However, suffice it note here that shutter element array 310 passes into roller housing 11 and travels between drive tractor 307 and idler tractor 304 on one side and between drive tractor 311 and idler tractor 305 on the opposite side and continues therefrom to be rolled upon take-up roll 360. It should be recalled that in accordance with the structure of shutter elements and the links coupled therebetween, the shutter element array includes alternately spaced ribs and valleys which are directly engageable with belts 325, 358, 331 and 342 of the tractor drive mechanism. Accordingly, and in accordance with the operation set forth below in FIG. 10 in greater detail, the energizing of tubular motor 323 in the take-up direction draws shutter element array 310 into roller housing 11 in the direction indicated by arrow 320 to be rolled upon take-up roll 360. Conversely, the energizing of tubular motor 323 (seen in FIG. 10) in the opposite direction drives shutter element array 310 outwardly from roller housing 11 in the direction indicated by arrow 321. Thus, it will be important to note that in both directions the movement of shutter element array 310 which comprises the above-described plurality of shutter elements and connecting links is caused by a directly engaged drive mechanism and thus does not require or rely upon the gravitational action upon the shutter element array. On the contrary, an important object of the present invention is to provide direct powered drive of the shutter element array in both the unrolling and rolling directions. Thus, it will be noted that as described above, the present invention rolling shutter and shutter drive may be operated at virtually any angular orientation or position including side to side and upside down.

FIG. 10 sets forth a section view of roller housing 11 taken along section lines 10—10 in FIG. 9. As described above, end plate 302 (seen in FIG. 9) supports a tubular motor 323 in accordance with conventional fabrication techniques (not shown). Tubular motor 323 in turn supports a rotatable sleeve 324 to which drive axle tube 301 is engaged and to which a double-side or double tooth belt 325 is coupled. An idler pulley 326 is rotatably supported by a shaft 327 also secured to end plate 302 by conventional fabrication techniques (not shown) such that pulley 326 is also within two-sided belt 325. A drive axle tube 301 defines a plurality of external ribs and valleys together with a plurality of internal ribs and valleys. Drive axle tube 301 is received upon sleeve 324 using engagement of its internal ribs and valleys. Similarly, the external ribs and valleys of drive axle tube 301 engage the interior teeth of double-toothed belt 325. Thus, the combination of tubular motor 323, sleeve 324, drive axle tube 301, belt 325, pulley 326 and shaft 327 cooperate to form drive tractor 307. An idler tractor 304 includes a double-sided or double-toothed belt 358 supported by a plurality of pulleys 350, 352 and 354 which in turn are supported by a plurality of shafts 351, 353 and 355 in accordance with conventional fabrication techniques (not shown). The function of idler tractor 304 is to define a travel path for shutter element array 310 in positive engagement with belt 325 of drive tractor 307. Thus, the overlapping portions of drive belt 325 of drive tractor 307 and belt 358 of idler tractor 304 captivates a portion of shutter element array 310 from both sides in direct positive engagement thereby carefully controlling the movement of shutter element array 310. In addition, the position of pulley 354 provides a preguidance alignment or bend about which shutter element 310 is flexed to easily pass between drive tractor 307 and idler tractor 304. Shutter element array 310 emerges from the overlapping portions of drive tractor 307 and idler tractor 304 to be wound upon a take-up roller 360. The latter includes a support shaft 361 and a torsion spring 362 both constructed in accordance with conventional fabrication techniques. The purpose of spring 362 is to provide a torsional force upon take-up roller 360 urging roller 360 toward rotation in the direction indicated by arrow 312.

It should be noted that shutter element array 310 is preferably formed to use several narrower shutter elements 190 closest to take-up roller 360 followed by somewhat wider shutter elements 170 which in turn are followed by still wider shutter elements 140. This facilitates the use of a smaller diameter take-up roller for roller 360 which in turn decreases roll thickness.

To facilitate maintenance and installation of the present invention rolling shutter, idler tractor 304 is preferably supported about an offset support pin 356 in accordance with conventional attachment techniques (not shown) in combination with end plate 302. The offset support of idler tractor 304 facilitates pivoting idler tractor 304 in the direction indicated by arrow 357 to the raised dashed-line position shown in FIG. 10. As can be seen, this releases shutter element array 310 from engagement with both idler tractor 304 and drive tractor 307.

Figure 11:
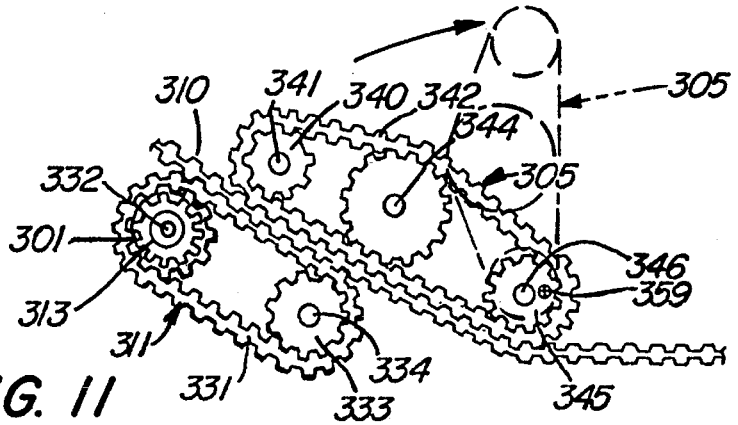
FIG. 11 sets forth a partial section view of the present invention rolling shutter and shutter drive taken along section lines 11—11 in FIG. 9.

FIG. 11 sets forth a partial section view of roller housing 11 taken along section lines 11—11 in FIG. 9. It should be noted by temporary reference to FIG. 9 that drive axle tube 301 extends transversely across roller housing 11 and is rotatably supported by end plate 303 and axle 332. Returning to FIG. 11, a drive tractor 311 includes an adaptor 313 rotatably supported upon axle 332 which in turn receives drive axle tube 301. Drive axle tube 301 in turn receives a double-sided or double-toothed belt 331. An idler pulley 333 supported by a shaft 334 is also encircled by belt 331. An idler tractor 305 substantially identical to idler tractor 304 shown in FIG. 10 is supported by end plate 303 in accordance with conventional fabrication techniques (not shown) including an offset pivotal attachment 359. Thus, idler tractor 305 includes a plurality of idler pulleys 340, 343 and 345 rotatably supported by a corresponding plurality of shafts 341, 344 and 346 respectively. A double-sided or double-toothed belt 342 encircles pulleys 340, 343 and 345. Idler tractor 305 is pivotable to the dashed-line position shown to release shutter element array 310 and facilitate servicing an installation thereof. It will be apparent to those skilled in the art that the operation of drive tractor 311 and idler tractor 305 is substantially identical to the operation of drive tractor 307 and idler tractor 304 described below. The difference being that drive tractor 311 and idler tractor 305 are operative upon the opposite side of shutter element array 310.

It should be recalled that the above-described descriptions of shutter element array 310 and particularly the coupling links used therein each facilitate at least a small pivotal movement between the coupling links and the shutter elements. Thus, with temporary reference to FIG. 2A, it will be recalled that planar links such as link 48 facilitate small angle pivotal motion of the coupled shutter elements such as elements 28 and 29 coupled thereto. In addition, angle links such as link 49 provide substantial angular pivotal motion of the coupled shutter element such as element 30 in one direction to form the triangularized configuration shown in FIG. 2B. However, it should also be noted that element 30 is pivotable in the opposite direction through a small angular displacement in addition. Similarly, angle links such as link 49 facilitate small angle pivotal motion of the coupling element on the opposite side such as element 29. In a similar manner, apex links such as link 50 in addition to facilitating large angle pivotal motion to form the triangularized configuration shown in FIG. 2 also facilitates small angle pivotal motion of the coupled elements such as elements 30 and 31 in the opposite direction. Returning to FIGS. 9 and 10, it will be apparent to those skilled in the art that the capability of each shutter element and coupling link within shutter element array 310 to undergo at least small angle pivotal motion facilitates the movement of the shutter element array between drive tractors 307 and 311 and idler tractors 304 and 305 and thereafter onto take-up roller 360. Thus, the novel, shutter element and link fabrication of the present invention facilitates a direct positive drive of the shutter element array not heretofore realized in prior art structures. This direct positive drive in turn facilitates the capability of the present invention rolling shutter by which it may be configured in the high strength reinforced triangularized configuration described above. It will be apparent to those skilled in the art that the width of shutter elements as well as the diameter of the take-up roller are selected to suit the installation parameters in which the present invention rolling shutter and shutter drive is to be installed including such considerations as overall opening length to be covered by the shutter.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A rolling shutter covering an area comprising:

a shutter element array having a plurality of elongated shutter elements and a plurality of elongated links intercoupling said shutter elements;

a take-up roll coupled to said shutter element array for rolling said shutter element array;

a shutter drive operatively coupled to said shutter element array for moving said shutter element array to and from said take-up roller; and shutter guide means for guiding said shutter element array into a position overlying said area, said elongated links including at least one set formed of an apex link coupled to a pair of said shutter elements and a pair of angle links coupled to each of said shutter elements in said pair such that said pair of shutter elements form an included angle therebetween less than one hundred eighty degrees when said shutter element array is compressively loaded.

2. A rolling shutter as set forth in claim 1 wherein said shutter elements each define a pair of elongated generally cylindrical sockets on each edge thereof and wherein said links each include a pair of elongated cylindrical portions each received within one of said generally cylindrical sockets to form a pivotal coupling between said link and an adjacent shutter element in said array.

3. A rolling shutter as set forth in claim 2 wherein each of said links include an elongated center body coupled to and supporting said pair of elongated cylindrical portions on opposed sides thereof.

4. A rolling shutter as set forth in claim 3 wherein each of said links define a valley portion between each center body and its adjacent elongated cylindrical portions and wherein each of said generally cylindrical sockets of said shutter elements includes a pair of end portions which extend into said valley portions of said link as it pivots with respect to the pivotally attached one of said shutter elements.

5. A rolling shutter as set forth in claim 4 wherein each of said links includes a pair of webs extending outwardly from said center body providing support for said elongated cylindrical portions, said end portions of said shutter elements contacting said webs to limit pivotal motion of said shutters.

6. A rolling shutter as set forth in claim 5 wherein said apex links define substantially deeper valley portions on one side and shallower valley portions on the opposite side.

7. A rolling shutter as set forth in claim 6 wherein said angle links define one deeper valley portion and three shallower valley portions.

8. A rolling shutter as set forth in claim 7 wherein said elongated links includes planar links each having four shallower valley portions.

9. A rolling shutter as set forth in claim 5 wherein said web portions of said apex links each define a plurality of elongated slots formed therein.

10. A rolling shutter as set forth in claim 9 wherein each of said shutter elements defines a plurality of outwardly extending ribs and recessed interleaved valleys on each side thereof and wherein said shutter drive means includes:

a first tractor drive having at least two pulleys and an endless drive belt having extending teeth for engaging said shutter element ribs and valleys;

a bidirectional motor coupled to one of said at least two pulleys; and a first idler tractor having a plurality of pulleys and an endless belt having extending teeth for engaging said shutter element ribs and valleys, said idler tractor positioned in a spaced relationship from said tractor drive to define a space therebetween through which said shutter element array passes.

11. A rolling shutter as set forth in claim 10 wherein said shutter drive means further includes:

a second tractor drive having at least two pulleys and an endless drive belt having extending teeth for engaging said shutter element ribs and valleys;

a second idler tractor having a plurality of pulleys and an endless belt having extending teeth for engaging said shuttle element ribs and valleys; and a drive axle tube coupled to said motor and said first and second tractor drives.

12. A rolling shutter as set forth in claim 1 wherein each of said shutter elements defines a plurality of outwardly extending ribs and recessed interleaved valleys on each side thereof and wherein said shutter drive means includes:

a first tractor drive having at least two pulleys and an endless drive belt having extending teeth for engaging said shutter element ribs and valleys;

a bidirectional motor coupled to one of said at least two pulleys; and a first idler tractor having a plurality of pulleys and an endless belt having extending teeth for engaging said shuttle element ribs and valleys, said idler tractor positioned in a spaced relationship from said tractor drive to define a space therebetween through which said shutter element array passes.

13. A rolling shutter as set forth in claim 12 wherein said shutter drive means further includes:

a second tractor drive having at least two pulleys and an endless drive belt having extending teeth for engaging said shutter element ribs and valleys;

a second idler tractor having a plurality of pulleys and an endless belt having extending teeth for engaging said shuttle element ribs and valleys; and a drive axle tube coupled to said motor and said first and second tractor drives.

14. A rolling shutter as set forth in claim 1 wherein said shutter element array further includes a friction element having means for slidingly contacting said shutter guide means to provide a friction force partially resisting movement of said shutter element array.

15. A rolling shutter as set forth in claim 1 wherein said guide means include a pair of mirror-image guides on each side of said to-be-covered area.

16. A rolling shutter as set forth in claim 15 wherein said shutter element array includes a plurality of longer shutter elements each having opposed ends and a plurality of shorter shutter elements each having opposed ends, said shorter shutter elements being coupled in pairs to an apex link and an angle link.

17. A rolling shutter as set forth in claim 16 wherein said guides each define a first channel receiving said ends of said longer shutter elements and a second channel receiving both said ends of said longer and shorter shutter elements.

18. A rolling shutter as set forth in claim 17 wherein each of said guides include an intermediate wall dividing said first channel from said second channel.

19. A rolling shutter operable in vertical or non-vertical orientations comprising:

a plurality of elongated shutter elements;

a plurality of elongated links coupled between said shutter elements, said links facilitating configuration of said shutter elements into one or more rigid triangularized strengthening shutter element pairs;

shutter guide means for guiding said shutter elements into a position overlying an area; and drive means including a take-up roller coupled to said shutter elements for rolling and for moving said shutter elements and for configuring said shutter elements into said one or more rigid triangularized shutter element pairs.

* * * * *